US005638688A

United States Patent [19]

Reznikov et al.

[11] Patent Number: 5,638,688

[45] Date of Patent: Jun. 17, 1997

[54] METHOD OF AND APPARATUS FOR COOLING FOOD PRODUCTS

[76] Inventors: Lev Reznikov, 1510 Ocean Pkwy., #A17, Brooklyn, N.Y. 11230; Zachary Schulman, 30 Spring Meadow Rd., Mount Kisco, N.Y. 10536

[21] Appl. No.: 562,576

[22] Filed: Nov. 24, 1995

[51] Int. Cl.[6] ..... F25D 25/00

[52] U.S. Cl. ..... 62/62; 62/384

[58] Field of Search ..... 62/603, 384, 388, 62/62

[56] References Cited

U.S. PATENT DOCUMENTS 3,815,377 6/1974 Tyree, Jr. ..... 62/384

*Primary Examiner*—Ronald C. Capossela

*Attorney, Agent, or Firm*—Ilya Zborovsky

[57] ABSTRACT

For cooling food products stored in a container, liquid carbon dioxide is supplied into the interior of the container and discharged through nozzles producing jets directed against one another so as to form carbon dioxide snow for applying on the food product. The jets of the nozzles are adjusted so that a surface of the food product or the tray is uniformly covered with carbon dioxide snow.

14 Claims, 1 Drawing Sheet

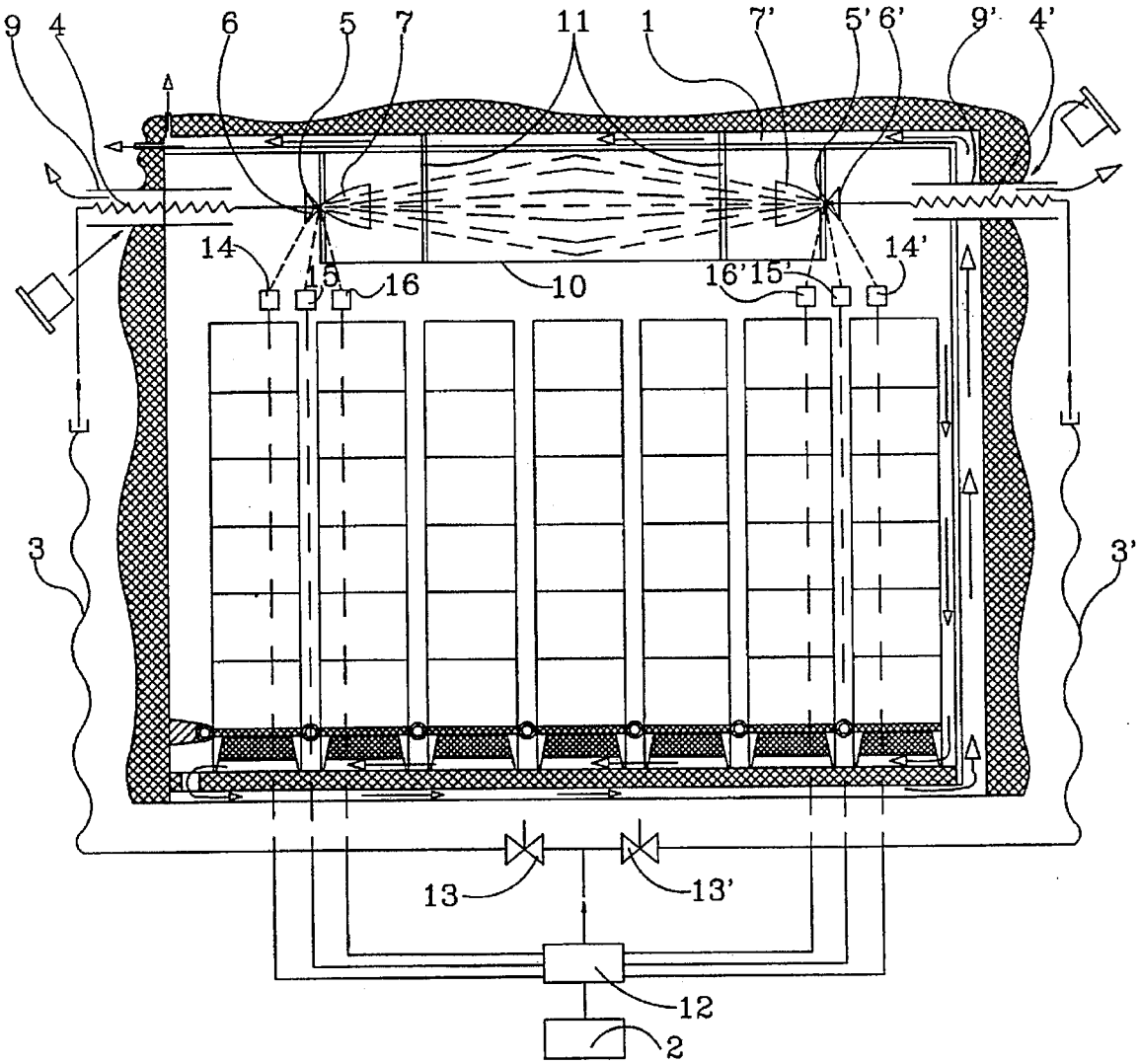
9
4
6
5
7
11
1
7'
5'
6'
9'
4'
14
15
16
10
16'
15'
14'
3
3'
13
13'
12
2

METHOD OF AND APPARATUS FOR COOLING FOOD PRODUCTS

BACKGROUND OF THE INVENTION

The present invention relates to a method of and an apparatus for cooling food products in containers and the like.

It is known that in order to cool the food products in containers and the like, carbon dioxide is supplied through nozzles which provide throttling with subsequent formation of carbon dioxide snow with simultaneous generation of carbon dioxide vapors. The speed of particles of the carbon dioxide snow is substantially high and therefore the process is accompanied by substantial withdrawal of cold-accumulating dry ice from the container in the flowing carbon dioxide vapors. Also, the pace of deposit of carbon dioxide snow is non-uniform. The nozzles are formed so that the jets discharged from them have constant parameters, and in the system with colliding jets the precipitation of snow is performed in a midpoint between the nozzles. Therefore, the distribution of carbon dioxide snow over the surface of the food product is non-uniform which can lead to over-freezing of one part of the food product and under-freezing of the other parts.

SUMMARY OF THE INVENTION

Accordingly, it is an object of the present invention to provide a method of and an apparatus for cooling food products, which avoids the disadvantages of the prior art.

In keeping with these objects and with others which will become apparent hereinafter, one feature of the present invention resides, briefly stated, in a method of cooling food products in a container, which has the steps of supplying into an interior of the container liquid carbon dioxide, discharging liquid carbon dioxide in the interior of the container by at least two nozzles which are arranged so that jets of liquid carbon dioxide discharged from the nozzles collide with one another, and adjusting the jets relative to one another so as to provide a substantially uniform distribution of carbon dioxide snow over a surface of the food product in the container.

It is also an object of the present invention to provide an apparatus for cooling food products in a container, which comprises means for supplying liquid carbon dioxide into a container, at least two nozzles connected with the supplying means and discharging liquid carbon dioxide in two jets directed toward one another so as to produce carbon dioxide snow, and means for adjusting the jets of the nozzles so as to provide a uniform distribution of carbon dioxide snow over a surface of the food products.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawings is a view schematically showing an apparatus for cooling food products in accordance with the present invention.

DESCRIPTION OF THE PREFERRED EMBODIMENTS

An apparatus in accordance with the present invention is used for cooling food products accommodated in a container

1. The apparatus has a tank 2 with liquid carbon dioxide which is supplied through lines 3 and 3' and inner pipes 4 and 4' to two nozzles 5 and 5'. The nozzles are associated with guide cones 6 and horns 7. Outer pipes 9 and 9' surround inner pipes 4 and 4' and extend through corresponding openings in the walls of the container 1. A tray 10 is mounted by supports 11 on the ceiling of the container 1.

During the operation of the apparatus, carbon dioxide is supplied through the lines 3, 3' and inner pipes 4 and 4' to the nozzles and discharged through the nozzles 5 and 5' by jets directed toward one another. As a result, carbon dioxide snow is produced for cooling the food products accommodated in the container so as to refrigerate the food products. Carbon dioxide vapors produced during this process move through a space between the outer tubes 9, 9' and inner tubes 4 and 4' and give its cold to liquid carbon dioxide supplied through the inner tubes 4, 4'. Then the carbon dioxide vapors are returned in liquefied state to the tank 2.

In accordance with the present invention, means are provided for adjusting a distribution of carbon dioxide snow in the interior of the container relative to the food product. The adjusting means include a control device which is identified as a whole with reference numeral 12. In accordance with one embodiment, the control device 12 is connected with adjustable valves 13 and 13' provided in the lines 3 and 3'. In this construction the control device 12 adjusts the supply of liquid carbon dioxide to the nozzles 5 and 5'. In particular, the supply of the liquid carbon dioxide to one nozzle can be different from the supply of liquid carbon dioxide to the other nozzle. This can be achieved by changing the cross-section of a corresponding passage in the valve 12 and 12'. It is advisable to adjust the supplies so that one of the nozzles discharges the maximum quantity of carbon dioxide while the other of the nozzles at the same time discharges a minimal quantity of carbon dioxide. At the same time the total supply of carbon dioxide through both nozzles can be constant. In this situation a point of colliding of the two jets of carbon dioxide is offset toward the nozzle which has a lower jet speed, maximum precipitation of carbon dioxide snow is provided in this area.

In accordance with another embodiment of the present invention, the control device 12 provides signals to the nozzles 5 and 5' through signal lines 14 and 14' so as to change a throughflow cross-section of the nozzles and therefore a cross-section of carbon dioxide jets discharged from the nozzles with corresponding change of their kinetic energies. The mass flow of the carbon dioxide remains the same, and at the same time, similarly to the first embodiment, the colliding point is displaced toward the nozzle with lower jet speed.

In accordance with still another embodiment of the present invention, the control device 12 is connected with executing devices 15 and 15' which oscillate the nozzles 5 and 5' in a horizontal plane. The discharge flow and speed can be the same for both nozzles. In this embodiment the colliding point oscillates over the food product and uniformly covers its surface.

In accordance with still another feature of the present invention the control device 12 is connected with executing devices 16 and 16' which activate corresponding parts of the nozzles 5 and 5' so that the nozzles in part oscillation to liquid carbon dioxide jets in direction of movement. In other words, the jets are subdivided into portions of higher and lower density and higher and lower specific kinetic energy. It also provides adjustment of the jets and therefore uniform distribution of carbon dioxide snow over the surface of the food products.

Also, it is possible to connect the control device 2 with the executing devices which provide rotatable oscillation of the nozzles around a vertical axis.

It is to be understood that the above specified several embodiments can be combined, so that the adjustment of the distribution of the carbon dioxide snow can be provided by two or more solutions or embodiments.

It will be understood that each of the elements described above, or two or more together, may also find a useful application in other types of methods and constructions differing from the types described above.

While the invention has been illustrated and described as embodied in a method of and apparatus for cooling food products, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

What is claimed is:

1. A method of cooling food products in a container, comprising the steps of supplying into an interior of the container liquid carbon dioxide; discharging liquid carbon dioxide in the interior of the container by at least two nozzles which are arranged so that jets of liquid carbon dioxide discharge from the nozzles are directed toward and collide with one another; and periodically adjusting the jets relative to one another so as to displace a point of colliding the jets with one another and to thereby provide a substantially uniform distribution of carbon dioxide snow in the container.

2. A method as defined in claim 1, wherein said step of periodically adjusting includes reducing of supply of liquid carbon dioxide to one of nozzles and increases of supply of liquid carbon dioxide to another of the nozzles.

3. A method as defined in claim 1, wherein said step of adjusting includes changing a cross-section of said nozzles so as to displace the point of colliding of the jets discharged from said nozzles to one of said nozzles which produces a reduced speed and kinetic energy of the jet of liquid carbon dioxide.

4. A method as defined in claim 1, wherein said step of adjusting includes oscillating turning of the nozzles about a vertical axis.

5. A method as defined in claim 1, wherein said step of adjusting includes discharging the jets from said nozzles with alternating frequencies.

6. A method as defined in claim 1, wherein said step of adjusting includes imparting oscillating movements to the nozzles in a horizontal plane.

7. A method as defined in claim 1, wherein said step of adjusting includes oscillating of jets of the nozzles in direction of movement of the jets.

8. An apparatus for cooling food products in a container, comprising means for supplying liquid carbon dioxide into a container; at least two nozzles connected with said supplying means and discharging liquid carbon dioxide in two jets directed toward and collide with one another so as to produce carbon dioxide snow; and means for adjusting the jets of said nozzles so as displace a point of colliding the jets with one another and to thereby to provide a uniform distribution of carbon dioxide snow in the container.

9. An apparatus as defined in claim 8, wherein said adjusting means include means for changing a supply liquid through one of said nozzles so that a greater discharge of liquid carbon dioxide is provided, while through the other of said nozzles a smaller discharge of liquid carbon dioxide is provided.

10. An apparatus as defined in claim 8, wherein said adjusting means include means for changing a throughflow cross-section of said nozzles so as to displace the point of colliding of the jets discharged from said nozzles toward one of said nozzles having reduced speed and kinetic energy of the jet.

11. An apparatus as defined in claim 8, wherein said adjusting means include means for rotatably oscillating said nozzles about a vertical axis.

12. An apparatus as defined in claim 8, wherein said adjusting means include means for discharging the jets from said nozzles with alternating frequencies.

13. An apparatus as defined in claim 8, wherein said adjusting means include means for oscillating said nozzles in a horizontal plane.

14. An apparatus as defined in claim 8, wherein said adjusting means include means with which said nozzles impart to the jets oscillation in a direction of movement of the jets.

* * * * *